US009675899B2

(12) United States Patent
Nishimoto et al.

(10) Patent No.: US 9,675,899 B2
(45) Date of Patent: Jun. 13, 2017

(54) FORM CHANGING TOY

(71) Applicant: TOMY COMPANY, LTD., Tokyo (JP)

(72) Inventors: Hisao Nishimoto, Ichikawa (JP); Yasuo Takahama, Urayasu (JP); Yohei Oikawa, Tsukubamiral (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 14/953,847

(22) Filed: Nov. 30, 2015

(65) Prior Publication Data

US 2017/0036130 A1 Feb. 9, 2017

(51) Int. Cl.

| | |
|---|---|
| ***A63H 3/12*** | (2006.01) |
| ***A63H 33/00*** | (2006.01) |
| ***A63H 17/26*** | (2006.01) |
| ***A63H 3/36*** | (2006.01) |

(52) U.S. Cl.

CPC ..... *A63H 33/003* (2013.01); *A63H 3/36* (2013.01); *A63H 17/26* (2013.01)

(58) Field of Classification Search

USPC ..... 446/71, 72, 97, 268, 269, 274, 279, 280, 446/291, 286, 289, 321

See application file for complete search history.

(56) References Cited

U.S. PATENT DOCUMENTS 3,830,012 A * 8/1974 Franke ..... A63H 3/006 273/155
4,030,239 A * 6/1977 White ..... A63H 3/48 446/321
4,391,060 A * 7/1983 Nakane ..... A63H 33/003 446/94
4,568,304 A * 2/1986 Santa Maria ..... A63H 3/12 446/321
4,623,317 A * 11/1986 Nagano ..... A63H 11/10 446/289
5,588,898 A * 12/1996 Ooba ..... A63H 3/12 446/321
7,568,965 B2 * 8/2009 Toriyama ..... A63H 3/003 446/279

(Continued)

FOREIGN PATENT DOCUMENTS

JP 2012-187353 10/2012

OTHER PUBLICATIONS

J-PlatPat Abstract, Publication No. 2012-187353, Published Oct. 4, 2012.

*Primary Examiner* — Kurt Fernstrom
(74) *Attorney, Agent, or Firm* — Staas & Halsey LLP

(57) ABSTRACT

A form changing toy including the following is shown. A rotating axis is provided in a cover member. A plurality of figures are provided on the rotating axis and form a predetermined form different from each other with the cover member. A handle is provided on the cover member. A power transmission mechanism transmits to the rotating axis operation power of the handle in one direction to rotate the rotating axis in one direction. Each one of the plurality of figures takes a first state covered by the cover member and then takes a second state jumping out from the cover member and then takes the first state from the second state in order according to operation of the handle in one direction.

16 Claims, 7 Drawing Sheets

(56) References Cited

U.S. PATENT DOCUMENTS

| | | | | |
|---|---|---|---|---|
| 8,011,992 | B2 * | 9/2011 | Ejima | A63H 17/02 446/376 |
| 8,128,450 | B2 * | 3/2012 | Imai | A63H 33/003 446/14 |
| 8,348,715 | B2 * | 1/2013 | Miyake | A63H 17/02 446/321 |
| 8,992,284 | B2 * | 3/2015 | Weidetz | A63H 33/003 446/310 |
| 2007/0015433 | A1 * | 1/2007 | Howard | A63H 3/365 446/321 |
| 2014/0370777 | A1 * | 12/2014 | Minassian | A63H 33/003 446/102 |

* cited by examiner

FORM CHANGING TOY

BACKGROUND

Field of the Invention

The present invention relates to a form changing toy.

Description of Related Art

There are various known form changing toys in which the form can be reversibly changed between a first form and a second form (for example, Japanese Patent Application Laid-Open Publication No. 2012-187353).

In such form changing toy, the operation to change from the first form to the second form is different from the operation to change from the second form to the first form. Therefore, the operation is complicated.

For example, in the form changing toy described in Japanese Patent Application Laid-Open Publication No. 2012-187353, the toy includes a projecting member which is provided projecting to the front in a mobile form, and which can change the position to the back when the form changing toy crashes into an obstacle, and a form changing mechanism which starts when the projecting member changes its position to the back, and which changes the toy from the mobile form to a different form. When the toy crashes into an obstacle, the form is changed at once from the first form to the second form. The form can also be changed from the first form to the second form by operating the projecting member manually. However, a folding operation is necessary to change the form from the second form to the first form.

As described above, in a form changing toy, the operation to change from the first form to the second form is usually different from the operation to change from the second form to the first form. This is a problem because operation is difficult for small children.

SUMMARY

The present invention has been made in consideration of the above problems, and one of the main objects is to provide a form changing toy in which the form can be successively changed by easy operation.

In order to achieve at least one of the above-described objects, according to an aspect of the present invention, there is provided a form changing toy including:

a cover member;

a rotating axis which is provided in the cover member;

a plurality of figures which are provided on the rotating axis and which form a predetermined form different from each other with the cover member;

a handle which is provided on the cover member; and a power transmission mechanism which transmits to the rotating axis operation power of the handle in one direction to rotate the rotating axis in one direction, wherein, each one of the plurality of figures takes a first state covered by the cover member and then takes a second state jumping out from the cover member and then takes the first state from the second state in order according to operation of the handle in one direction.

Preferably, in the form changing toy, the power transmission mechanism includes a rack which operates by operation of the handle and a pinion which is fitted with the rack and rotates by operation of the rack.

Preferably, in the form changing toy, the handle can be operated in one direction and another direction; and the power transmission mechanism includes a one way clutch which transmits power to the rotating axis when the handle is operated in one direction and which cuts the power midway when the handle is operated in the other direction.

Preferably, in the form changing toy, the cover member is provided with a movable member which moves against predetermined bias force by at least one of the figures coming into contact by sliding when at least one of the plurality of figures switches from the first state to the second state according to rotation of the rotating axis to allow at least one of the figures to switch from the first state to the second state.

Preferably, in the form changing toy, at least one of the figures of the plurality of figures is provided with a movable portion which moves by gravity when the at least one figure takes the second state.

Preferably, in the form changing toy, the cover member includes a contact portion which folds the movable portion with contact force when the figure provided with the movable portion changes from the second state to the first state.

Preferably, the form changing toy further includes a positioning mechanism which performs positioning when one of the plurality of figures takes the second state.

Preferably, in the form changing toy, the cover member is formed in a shape of a head of a doll;

two figures are provided as the plurality of figures;

one of the two figures is in a form of a car; and the other of the two figures is a torso, a hand, and a foot of the doll.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

Figure 1:
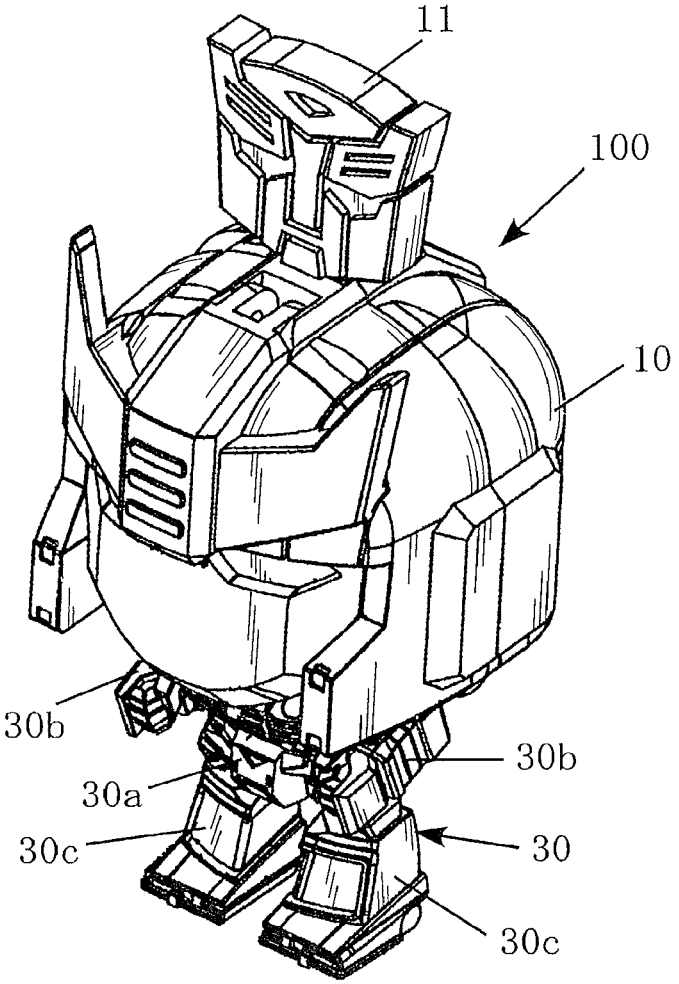
FIG. 1 is a perspective view showing a first form of a form changing toy according to the present embodiment.

A form changing toy of the present invention is described based on the embodiments shown in the drawings.

(Outline Configuration)

Figure 2:
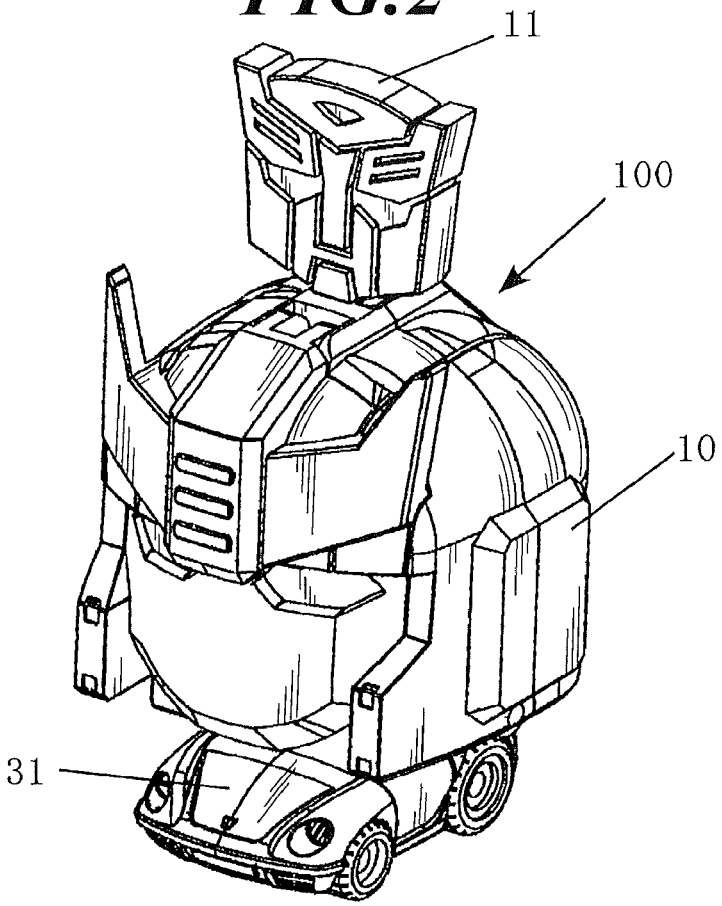
FIG. 2 is a perspective view showing a second form of a form changing toy according to the present embodiment.

FIG. 1 and FIG. 2 show a form changing toy 100. Although not limited, the form changing toy 100 here is formed in a size so that the entire toy can be held with one hand.

The form changing toy 100 includes a cover member 10 resembling a head of a doll. A tongue piece shaped handle 11 which can be in a standing state and a backward lying state is provided at a top of the cover member 10. The handle 11 can be moved up and down to be close to or far from the cover member 10, and the handle 11 is biased in the direction to be close to the cover member 10 by a later described coil spring 12. By holding the handle 11 between a thumb and a pointing finger of one hand and pulling the handle 11 up, the handle 11 moves away from the cover member 10 against the bias force of the coil spring 12. By loosening the pull of the handle 11, the handle 11 moves close to the cover member 10 by the bias force of the coil spring 12.

As described above, the form changing toy 100 becomes the first form shown in FIG. 1 or the second form shown in FIG. 2, respectfully, each time the handle 11 is pulled upward.

(Detailed Configuration)

1. Cover Member 10

Figure 3:
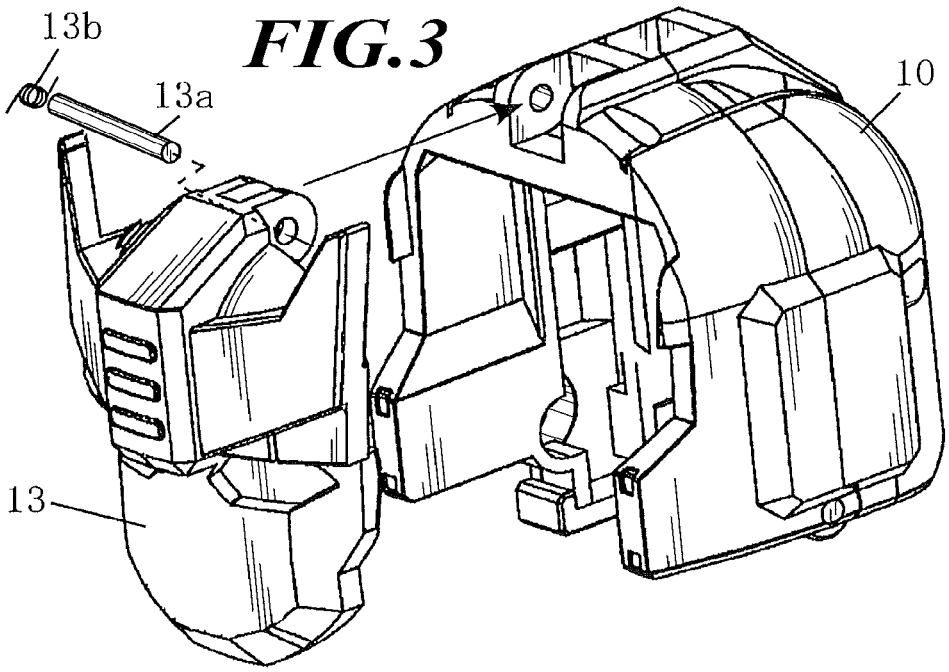
FIG. 3 is an exploded perspective view showing a cover member of a form changing toy.

As described above, the cover member 10 is formed resembling a head of a doll. As shown in FIG. 3, the cover member 10 is hollow inside, and the hollow portion is open from the bottom edge of the covering member 10 toward the back edge of the lower half portion (see FIG. 4).

A front side cover portion 13 (portion corresponding to a face of the doll) of the cover member 10 is rotatable to the front and back around a horizontal axis 13*a* near the top of the head. The front side cover portion 13 is normally in a hanging position (standard position) by a bias force of a torsion spring 13*b* wound around the axis 13*a*. When external force has an effect from the inside on the bottom edge portion of the inner face of the front side cover portion 13, the front side cover portion 13 rotates toward the front so as to push the bottom of the front side cover portion 13 out against the bias force of the torsion spring 13*b*. One end of the torsion spring 13*b* connects to the cover member 10 and the other end connects to the front side cover portion 13.

The operation and effect of the front side cover portion 13*a* will be described in detail later.

Figure 4:
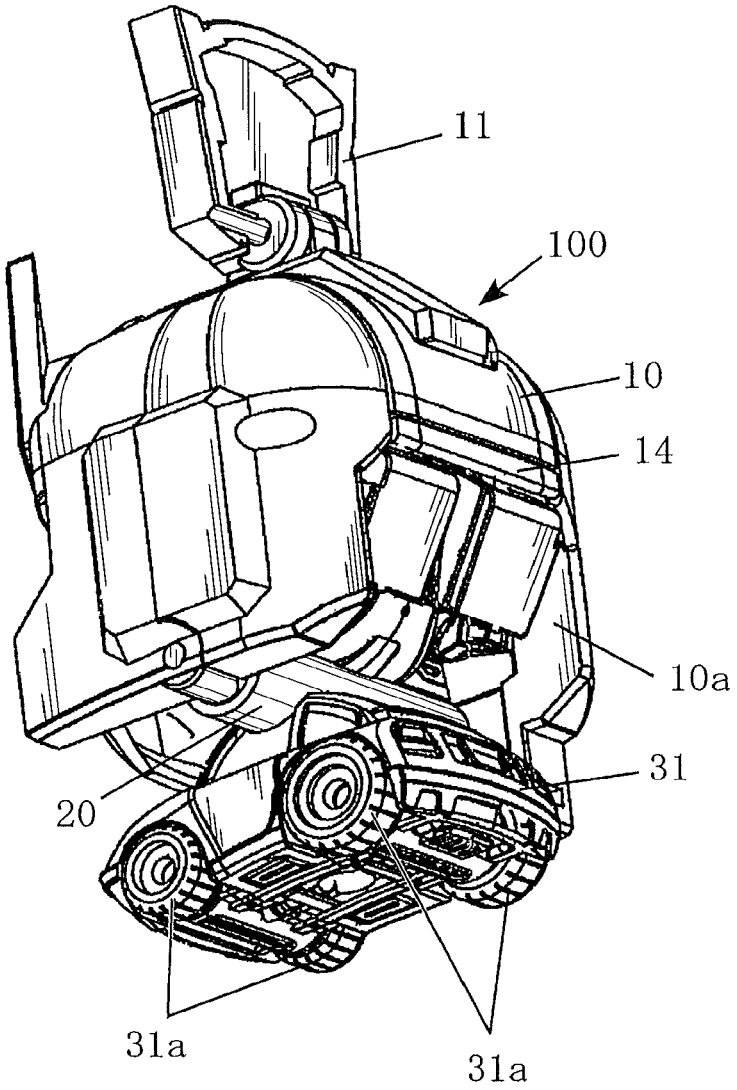
FIG. 4 is a perspective view showing a state viewing the form changing toy of the second form from the back diagonal lower side.

As shown in FIG. 4, the lower half portion of the back of the cover member 10 is cut out, and the top edge portion of a cutout portion 10*a* is to be a contact portion 14.

The operation and effect of the contact portion 14 will be described in detail later.

2. Rotating Axis 20, First Figure 30, and Second Figure 31

Figure 5:
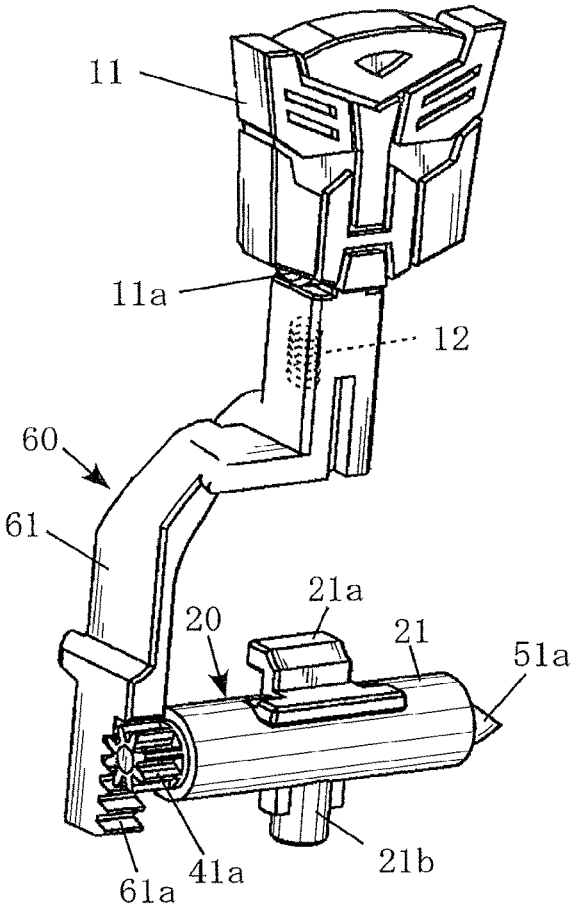
FIG. 5 is a perspective view showing a power transmission system of a form changing toy.
Figure 6:
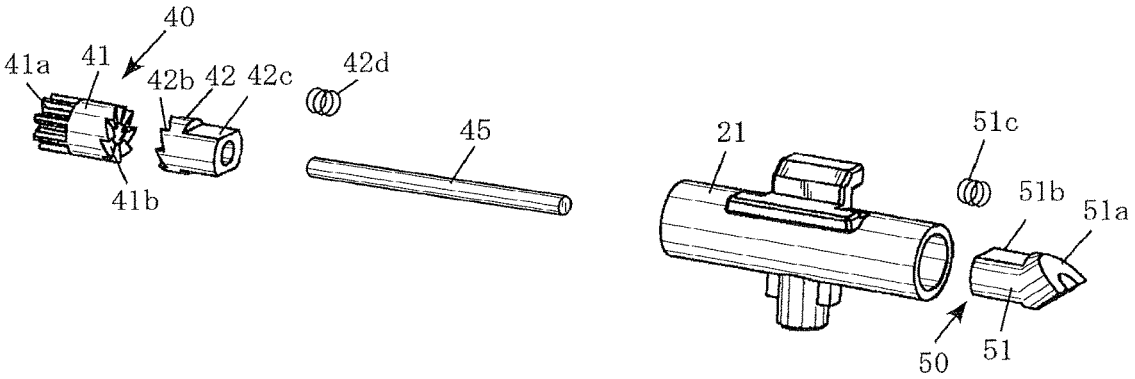
FIG. 6 is an exploded perspective view of a rotating axis, a clutch mechanism, and a positioning mechanism.

A rotating axis 20 is supported in the left and right edge portions of the bottom edge of the cover member 10. As shown in FIG. 5 and FIG. 6, the rotating axis 20 includes a cylindrical body 21. As shown in FIG. 78 and FIG. 89, a first FIG. 30 and a second FIG. 31 are provided at an even interval in a circumferential direction around the outer circumference of the cylindrical body 21. In FIG. 5, reference numeral 21*a* shows an attaching portion of the first FIG. 30 and reference numeral 21*b* shows an attaching portion of the second FIG. 31.

Figure 8:
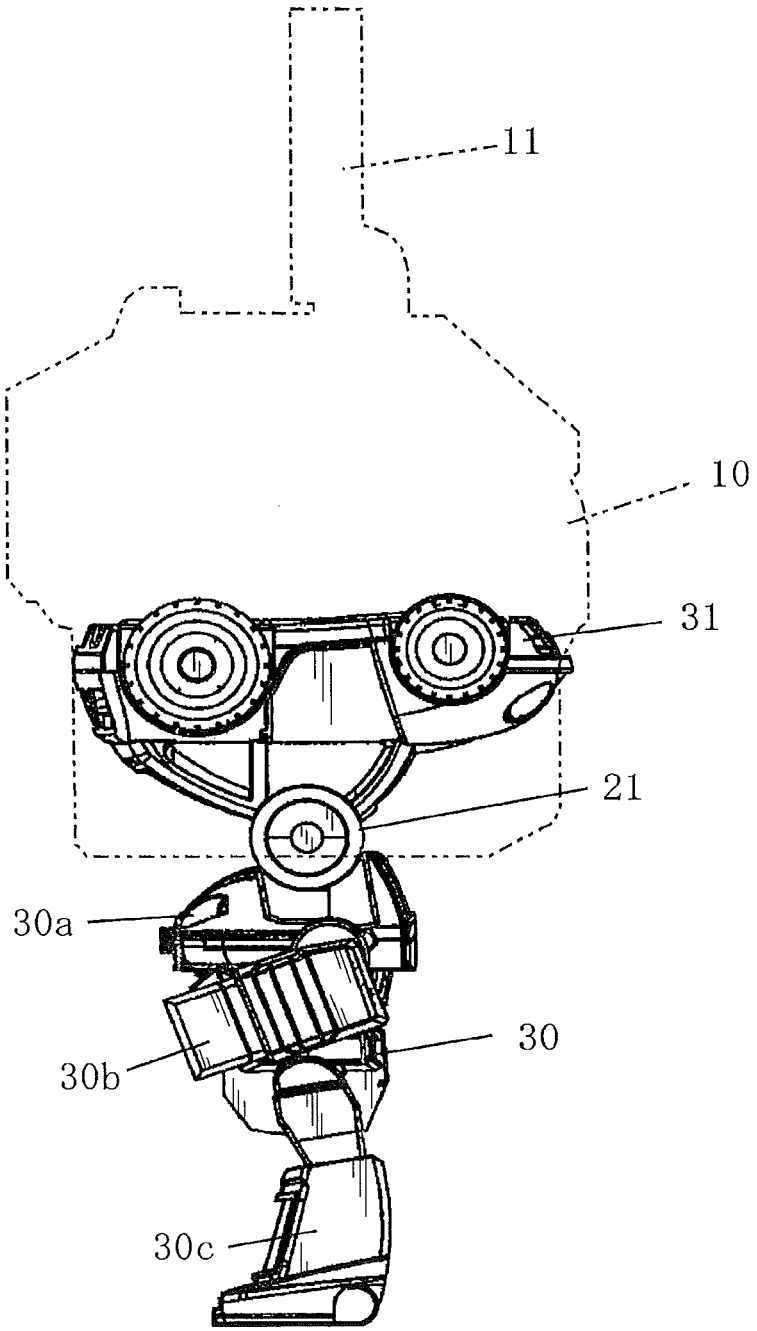
FIG. 8 is a side view showing a state of a first figure outside of the cover member.

The first FIG. 30 is in a form of a doll without the head. In other words, as shown in FIG. 1, the first FIG. 30 includes a torso 30*a*, hands 30*b* and feet 30*c* of a doll. As shown in FIG. 8, in the first FIG. 30, a neck-side of the torso 30*a* is connected to the cylindrical body 21. In the torso 30*a*, each hand 30*b* is attached so as to be rotatable around a root portion of an upper arm portion. Also in the torso 30*a*, the feet 30*c* are attached so as to be rotatable around a root portion of an upper leg. By rotation, each foot 30*c* can take a bent state (see FIG. 9) where a tip of the foot is close to a front of the torso 30*a* and an extended state (see FIG. 8) where the tip of the foot is separated from the torso 30*a*. In the form changing toy 100, when the first FIG. 30 jumps out from below the cover member 10, the foot 30*c* is in an extended state. With this, as shown in FIG. 1 and FIG. 8, the first form is taken with the cover member 10.

Figure 9:
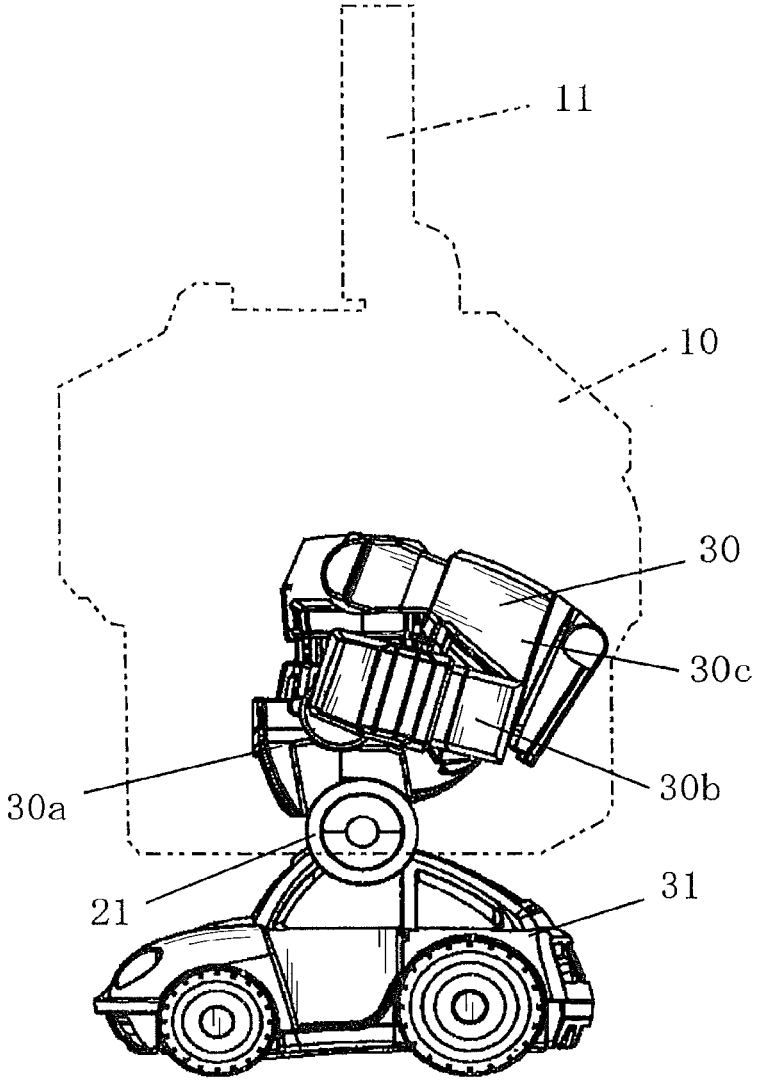
FIG. 9 is a side view showing a state of a second figure outside of the cover member.

The second FIG. 31 is in a form of a toy car. As shown in FIG. 8, in the second FIG. 31, a roof of the toy car is connected to the cylindrical body 21. Four wheels 31*a* are provided on the second FIG. 31 to be able to rotate idly on the bottom side of a chassis of the toy car. In the form changing toy 100, as shown in FIG. 2 and FIG. 9, when the second FIG. 31 jumps out from below the cover member 10, the second form is taken with the cover member 10.

3. Clutch Mechanism 40

A clutch mechanism 40 is included in the rotating axis 20.

In other words, a clutch piece 41 is included inside one edge of the cylindrical body 21. An outer edge portion of the clutch piece 41 projects from the cylindrical body 21. A pinion 41*a* is formed in a projecting portion of the clutch piece 41. On the inner edge of the clutch piece 41, a plurality of teeth 41*b* in which an edge of a tip of each tooth spreads radially are formed at an even interval in the circumferential direction. Each tilted angle between two faces divided by the tooth tip edge in each tooth 41*b* is different from each other. The teeth 41*b* compose clutch teeth, and the clutch piece 41 is able to rotate idly with respect to the cylindrical body 21.

In the cylindrical body 21, another clutch piece 42 is included inside the clutch piece 41. Among the edge faces of any clutch piece 42, clutch teeth with a shape complement to the clutch teeth of the clutch piece 41 are formed on a face facing the clutch piece 41. In other words, on the face facing the clutch piece 41 among the edge faces of the clutch piece 42, a plurality of teeth 42*b* in which the edge of the tip of the tooth spreads radially are formed at an even interval in the circumferential direction. Each tilted angle between two faces divided by the tooth tip edge in each tooth 42*b* is different from each other. The other edge portion of the clutch piece 42 is formed in a thick plate shape including two faces 42*c* parallel to each other. These plate shaped faces 42*c* are fitted in a hole (not shown) inside the cylindrical body 21, and the clutch piece 42 rotates together with the cylindrical body 21. The clutch piece 42 is movable in an axis line direction of the cylindrical body 21.

A bar shaped axis 45 is provided through the clutch pieces 41 and 42. The clutch piece 42 is pressed toward the clutch piece 41, so that the clutch teeth fit each other by a coil spring 42*d* provided between a fixing portion in the cylindrical body 21. When the clutch piece 41 rotates in a positive direction, the power is transmitted to the cylindrical body 21 through the clutch pieces 41 and 42. When the clutch piece 41 rotates in a reverse direction, the clutch teeth of the clutch pieces 41 and 42 slip between each other against the bias of the coil spring 42*d*, and the power is not transmitted to the cylindrical body 21.

4. Positioning Mechanism 50

A positioning mechanism 50 is provided iron the rotating axis 20.

In other words, an engaging member 51 is included in the other edge portion of the cylindrical body 21. An outer edge portion of the engaging member 51 is projected from the cylindrical body 21. A triangular bump 51*a* is formed on the projecting portion. The inner edge portion of the engaging member 51 is formed in a thick plate shape including two faces parallel to each other. These plate shaped portions 51*b* are fitted in a hole (not shown) inside the cylindrical body 21, and the engaging member 51 rotates together with the cylindrical body 21. The engaging member 51 is movable in an axis line direction of the cylindrical body 21.

Figure 7:
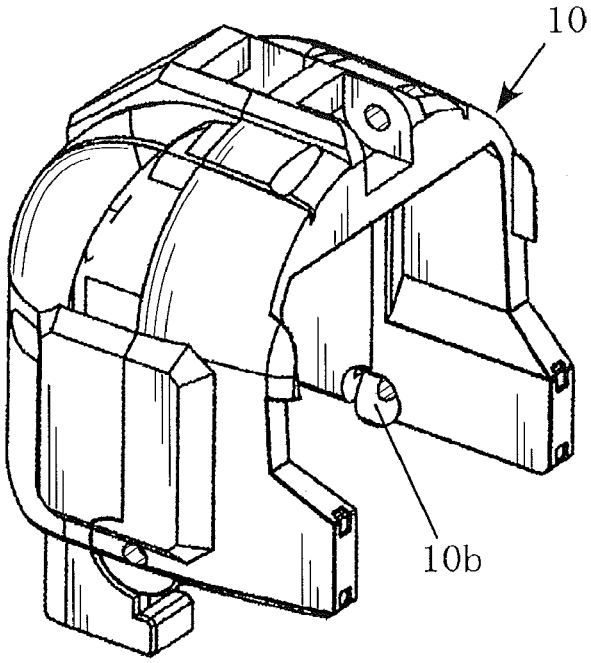
FIG. 7 is a perspective view showing the cover member viewed from the back diagonal upper side.

The axis 45 is provided through the engaging member 51 and the engaging member 51 is biased in a projecting direction from the cylindrical body 21 by a coil spring 51*c* provided between the engaging member 51 and a fixing portion in the cylindrical body 21. As shown in FIG. 7, a recessed portion 10*b* in a shape complement to the triangular bump 51*a* is formed on a face of the cover member 10 facing the edge face of the projecting portion of the engaging member 51. The triangular bump 51*a* engages with the recessed portion 10*b* in a position in which the first FIG. 30 or the second FIG. 31 jumps out from the cover member 10 with the rotation of the rotating axis 20.

The operation and effect of the positioning mechanism 50 will be described in detail later.

5. Handle 11 and Power Transmission Mechanism 60

The handle 11 composes a decoration portion above the head of the doll. As shown in FIG. 5, the handle 11 is connected to the top edge portion of a rack member 61, positioned inside the cover member 10, through an axis 11*a*. A top portion and a bottom portion of the rack member 61 extend in the upward and downward directions, respectfully, and a portion in a middle is in a bent shape and a curved shape. The top portion of the rack member 61 is positioned in the center of the cover member 10, and the bottom portion is positioned near the inner face of one side of the cover member 10. A rack 61*a* is formed to fit with the pinion 41*a* in the bottom edge portion of the rack member 61.

The coil spring 12 is provided between the top portion of the rack member 61 and the top of the head of the cover member 10, and the rack member 61 is biased downward by the coil spring 12.

6. Operation

Next, the operation of the form changing toy 100 is described.

For example, the handle 11 held between the thumb and the pointing finger of one hand is pulled upward to move the rack member 61 upward against the bias force of the coil spring 12.

When the rack member 61 moves upward, the pinion 41*a* fitted in the rack 61*a* is rotated. When the pinion 41*a* is rotated, the clutch piece 41 rotates simultaneously, and the clutch 42 and the cylindrical body 21 also follow and rotate. With this, the figures (first FIG. 30 or second FIG. 31) covered by the cover member 10 passes the front of the rotating axis 20 and jumps out from below the cover member 10. In this position, the bump 51*a* of the engaging member 51 fits with the recessed portion 10*b* of the cover member 10 to be positioned. The form changing toy 100 takes either the first form or the second form. The other figure (first FIG. 30 or second FIG. 31) passes the back of the rotating axis 20, reaches above the rotating axis 20 and is covered by the cover member 10.

When the figure covered by the cover member 10 reaches the front of the rotating axis 20, the figure slides with contact on the inner side of the front side cover portion 13. With this, the front side cover portion 13 rotates against the bias force of the torsion spring 13*b*. Therefore, the figure can jump out without being interfered by the front side cover portion 13. The hand 30*b* and the foot 30*c* drop down by its own weight when the first figure 30 jumps out from the cover member 10. In this case, the foot 30*c* is in an extended state hanging down from the torso 30*a*. When the first figure 30 passes the back of the rotating axis 20 and is stored in the cover member 10, the foot 30*c* hanging down comes into contact with the contact portion 14 to be rotated and folded in a form bent to the front.

When the handle 11 is let go after being pulled upward, the rack member 61 moves downward by the bias force of the coil spring 12.

When the rack member 61 moves downward, the clutch teeth of the clutch pieces 41 and 42 slip between each other against the bias force of the coil spring 42*d*, and the power is not transmitted to the cylindrical body 21. Therefore, the form of the form changing toy 100 is not changed.

(Modifications)

An embodiment of the present invention is described above, but the present invention is not limited to the embodiments described above. Various modifications are possible without leaving the scope of the present invention.

For example, according to the above-described embodiment, the figure jumps out downward from the cover member 10. Alternatively, the figure can jump out upward or sideways from the cover member 10.

According to the above-described embodiment, the pulling direction of the handle 11 is opposite of the direction that the figure jumps out with the cover member 10 in between. However, the direction of movement is not limited to the above.

According to the above-described embodiment, the coil spring 12 is used as the returning mechanism of the handle 11. Alternatively, other returning mechanisms such as a winding spring or elastic can be used.

According to the above-described embodiment, a tongue piece shaped plate is used as the handle 11. Alternatively, a dial or rotating handle can be used as the handle.

According to the present embodiment, the form is changed between two forms. Alternatively, three or more figures can be provided, and the form can be changed between three or more forms.

According to an aspect of the present invention, there is provided a form changing toy including:

a cover member;

a rotating axis which is provided in the cover member;

a plurality of figures which are provided on the rotating axis and which form a predetermined form different from each other with the cover member;

a handle which is provided on the cover member; and a power transmission mechanism which transmits to the rotating axis operation power of the handle in one direction to rotate the rotating axis in one direction, wherein, each one of the plurality of figures takes a first state covered by the cover member and then takes a second state jumping out from the cover member and then takes the first state from the second state in order according to operation of the handle in one direction.

According to the above aspect of the present invention, the form changing toy changes form by continuous or repetitive operation of the handle in one direction. Therefore, the operation to change the form can be done with very easy operation. For example, the form successively changes by simply pushing, pulling or rotating the handle in one direction. Consequently, even little children can easily enjoy change in form.

Preferably, in the form changing toy, the power transmission mechanism includes a rack which operates by operation of the handle and a pinion which is fitted with the rack and rotates by operation of the rack.

According to the above aspect, the linear motion of the handle can be easily changed to a rotating motion of the rotating axis by the rack/pinion mechanism. Consequently, the configuration becomes simple.

Preferably, in the form changing toy, the handle can be operated in one direction and another direction; and the power transmission mechanism includes a one way clutch which transmits power to the rotating axis when the handle is operated in one direction and which cuts the power midway when the handle is operated in the other direction.

According to the above aspect, a one way clutch is provided. Consequently, the present invention can be applied to a handle in which repeated reciprocating motion is necessary to operate one way.

Preferably, in the form changing toy, the cover member is provided with a movable member which moves against predetermined bias force by at least one of the figures coming into contact by sliding when at least one of the plurality of figures switches from the first state to the second state according to rotation of the rotating axis to allow at least one of the figures to switch from the first state to the second state.

According to the above aspect, a movable member is provided in the cover member. Consequently the present invention can be applied to a relatively large figure.

Preferably, in the form changing toy, at least one of the figures of the plurality of figures is provided with a movable portion which moves by gravity when the at least one figure takes the second state.

According to the present invention, a movable portion which moves by gravity is included, and the movable portion moves when the form changes. Consequently, interesting change in form is possible.

Preferably, in the form changing toy, the cover member includes a contact portion which folds the movable portion with contact force when the figure provided with the movable portion changes from the second state to the first state.

According to the present invention, the movable portion can be folded. Consequently, the storing to the cover member is easy.

Preferably, the form changing toy further includes a positioning mechanism which performs positioning when one of the plurality of figures takes the second state.

According to the present invention, since the position mechanism is included, the form after change can be easily maintained.

Preferably, in the form changing toy, the cover member is formed in a shape of a head of a doll;

two figures are provided as the plurality of figures;

one of the two figures is in a form of a car; and the other of the two figures is a torso, a hand, and a foot of the doll.

According to the present invention, the form changes between a doll and a car. Consequently, interesting change in form is possible.

Although various exemplary embodiments have been shown and described, the invention is not limited to the embodiments shown. Therefore, the scope of the invention is intended to be limited solely by the scope of the claims that follow and its equivalents.

The present U.S. patent application claims priority under the Paris Convention of Japanese Utility Model Application No. 2015-003931 filed on Aug. 3, 2015 the entirety of which is incorporated herein by reference.

What is claimed is:

1. A form changing toy comprising:

a cover member;

a rotating axis which is provided in the cover member;

a plurality of figures which are provided on the rotating axis, each of which figures is movable between a first position inside the cover member and a second position outside the cover member;

a movable handle which is provided on the cover member; and a power transmission mechanism connected to the handle and which transmits to the rotating axis operation power from the movement of the handle in only one direction to rotate the rotating axis in only one direction, wherein, when the handle is moved in the one direction, one of the plurality of figures moves via the rotating axis from the first position to the second position, or from the second position to the first position.

2. The form changing toy according to claim 1, wherein, the power transmission mechanism includes a rack which operates by the movement of the handle and a pinion which is fitted with the rack and rotates by operation of the rack.

3. The form changing toy according to claim 1, wherein, the handle can be operated in the one direction and in another direction; and the power transmission mechanism includes a one way clutch which transmits the operation power to the rotating axis when the handle is operated in the one direction, but not when the handle is operated in the another direction.

4. The form changing toy according to claim 3, wherein the handle is urged into the another position by a biasing mechanism.

5. The form changing toy according to claim 4, wherein the biasing mechanism is one of a coil spring, a winding spring or an elastic member.

6. The form changing toy according to claim 1, wherein the cover member is provided with a movable member which moves against predetermined bias force by the one of the plurality of figures coming into contact with the movable member, when the one of the plurality of figures moves from the first position to the second position to allow the one of the plurality of figures to move from the inside to the outside of the cover member.

7. The form changing toy according to claim 1, wherein the one of the plurality of figures is provided with a movable portion which moves downward by gravity when the at least one of the plurality of figures is in the second position.

8. The form changing toy according to claim 7 wherein the movable portion is at least one of a leg or an arm of the one of the plurality of figures.

9. The form changing toy according to claim 7, wherein; the cover member includes a contact portion which folds the movable portion with contact force when the one of the plurality of figures moves from the second position to the first position.

10. The form changing toy according to claim 9, wherein the moveable portion is a leg of the one of the plurality of figures.

11. The form changing toy according to claim 1, further comprising a positioning mechanism which temporarily holds the one of the plurality of figures in the first or second positions relative to the cover member.

12. The form changing toy according to claim 1, wherein, the cover member is formed in a shape of a head of a doll; two figures are provided as the plurality of figures;

one of the two figures is in a form of a car; and the other of the two figures is a torso, a hand, and a foot of the doll.

13. The form changing toy according to claim 12, wherein the car has rotatable wheels.

14. The form changing toy according to claim 1, wherein the movement of the handle in the one direction is one of linear or rotary.

15. The form changing toy according to claim 1, wherein the first position provides an overall appearance of one of a car or a doll, each with a head thereon.

16. The form changing toy according to claim 1, wherein the one of the plurality of figures includes a torso, two hands and two feet.

* * * * *